US010659890B2

(12) United States Patent
Dressler et al.

(10) Patent No.: US 10,659,890 B2
(45) Date of Patent: May 19, 2020

(54) METHOD FOR OPERATING A HEARING DEVICE AND A HEARING DEVICE

(71) Applicant: SIVANTOS PTE. LTD., Singapore (SG)

(72) Inventors: Oliver Dressler, Fuerth (DE); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/959,464

(22) Filed: Apr. 23, 2018

(65) Prior Publication Data

US 2018/0310105 A1 Oct. 25, 2018

(30) Foreign Application Priority Data

Apr. 21, 2017 (DE) ..... 10 2017 206 788

(51) Int. Cl.
*H04R 25/00* (2006.01)
*H04R 3/00* (2006.01)
*G10L 21/0208* (2013.01)

(52) U.S. Cl.
CPC ..... *H04R 25/505* (2013.01); *G10L 21/0208* (2013.01); *H04R 3/005* (2013.01); *H04R 25/407* (2013.01); *H04R 2225/41* (2013.01); *H04R 2225/43* (2013.01); *H04R 2430/03* (2013.01)

(58) Field of Classification Search
CPC .... H04R 25/505; H04R 3/005; H04R 25/407; H04R 2225/41; H04R 2225/43; H04R 25/40; G10L 21/02; G10L 21/0208; G10L 2021/02165
See application file for complete search history.

(56) References Cited

U.S. PATENT DOCUMENTS 8,238,593 B2 8/2012 Bisgaard et al.
8,358,789 B2 1/2013 Fischer et al.
8,600,087 B2 12/2013 Fischer
8,630,431 B2 1/2014 Gran
(Continued)

FOREIGN PATENT DOCUMENTS

DE 19844748 A1 10/1999
DE 102008055760 A1 5/2010
(Continued)

*Primary Examiner* — Sunita Joshi
(74) *Attorney, Agent, or Firm* — Laurence A. Greenberg; Werner H. Stemer; Ralph E. Locher

(57) ABSTRACT

A method for operating a hearing device. In the hearing device a first directional signal and a second directional signal are generated from an ambient sound signal. The first directional signal and the second directional signal are used to determine at a first response time a first adaptation coefficient for a first superposition of the first directional signal with the second directional signal for the purpose of noise suppression. It is intended here that the first directional signal and the second directional signal are used to determine at a second response time a second adaptation coefficient for a second superposition of the first directional signal with the second directional signal for the purpose of noise suppression. The first adaptation coefficient and the second adaptation coefficient are used to determine an output adaptation coefficient for forming an output signal by superposition of the first directional signal and the second directional signal.

11 Claims, 2 Drawing Sheets

(56) References Cited

U.S. PATENT DOCUMENTS

| | | | | |
|---|---|---|---|---|
| 8,891,780 | B2 | 11/2014 | Matsuo | |
| 2009/0022335 | A1* | 1/2009 | Konchitsky | H04R 1/406 381/92 |
| 2010/0046776 | A1* | 2/2010 | Fischer | H04R 25/407 381/313 |
| 2010/0171662 | A1* | 7/2010 | Sugiyama | G01S 3/802 342/378 |

FOREIGN PATENT DOCUMENTS

| | | | |
|---|---|---|---|
| DE | 102009012166 | A1 | 9/2010 |
| JP | 2004064584 | A | 2/2004 |
| JP | 2009542057 | A | 11/2009 |
| JP | 2010193213 | A | 9/2010 |
| JP | 2011244232 | A | 12/2011 |
| JP | 2015156699 | A | 8/2015 |

* cited by examiner 2
42
α-out
Adaptation Block
40
Linear Combination
α1
α2
Adaptation Block
38
30, t1
Hold Block
34
32, t2
36
8f
8r
28b
28a
26a
20
24a
24b
26b
T
T
+
−
−
+

METHOD FOR OPERATING A HEARING DEVICE AND A HEARING DEVICE

CROSS-REFERENCE TO RELATED APPLICATION

This application claims the priority, under 35 U.S.C. § 119, of German application DE 10 2017 206 788.8, filed Apr. 21, 2017; the prior application is herewith incorporated by reference in its entirety.

BACKGROUND OF THE INVENTION

Field of the Invention

The invention relates to a method for operating a hearing device. In the hearing device a first directional signal and a second directional signal are generated from an ambient sound signal. The first directional signal and the second directional signal are used to determine an adaptation coefficient for superposition of the first directional signal with the second directional signal for the purpose of noise suppression. An output signal is formed by superposition of the first directional signal with the second directional signal.

In hearing devices, one of the most frequent problems to arise is how to improve the signal-to-noise ratio (SNR) for specific hearing situations. This is often achieved by direction-dependent signal processing algorithms. It is often assumed in these algorithms that a highly localized wanted signal component, for instance in the form of elements of conversation from a conversational partner, is present in the ambient sound signal entering the hearing device. Directional signals are then used in the hearing device to isolate this wanted-signal component from a background, which is assumed to be a noise signal, even though the noise signal may also exhibit significant directionality. In general, the algorithms mentioned often use here self-optimization, in which the directivity pattern of a directional signal is adapted so as to minimize the effect of noise signals from that direction in which they make the greatest contribution. This is usually done by minimizing the signal power of a corresponding directional signal.

In a first-order differential directional microphone having only one adaptation coefficient, a directional output signal is often obtained by a linear combination of a forward-facing cardioid with a backwards-facing cardioid. The directivity pattern can be altered here by the adaptation coefficient, which determines the contribution of the backwards-facing cardioid. It is thereby possible to reduce the contributions from background-noise sources, which may lie in a wide solid-angle range with respect to the forward direction of the hearing device. This does not apply, however, to a background-noise source that is positioned in the forward direction and thus in the "notch" of the backwards-facing cardioid.

For a steady background-noise source positioned in the rear hemisphere and a simultaneously present transient wanted-signal source in the front hemisphere (outside the "notch" of the backwards-facing cardioid), an algorithm for adapting the directional signal to the hearing situation must take into account different contributions from both sound sources to the signal power. If, in this case, the transient signal from the wanted-signal source has a sufficiently high SNR, then the adaptation coefficient varies with the signal power of the wanted signal. This can affect the attenuation of the steady noise, however, with the result that the noise, which is actually steady, is incorporated in the output signal as a noise that fluctuates according to the presence of the transient wanted signal (co-modulation). If the wanted signal is a speech signal here, this can impair both the speech quality and the speech intelligibility.

SUMMARY OF THE INVENTION

Thus the object of the invention is to define a method for operating a hearing device, by which method a steady noise can be suppressed with minimum possible effect from a transient wanted signal.

The object is achieved according to the invention by a method for operating a hearing device. In the hearing device a first directional signal and a second directional signal are generated from an ambient sound signal. The first directional signal and the second directional signal are used to determine at a first response time a first adaptation coefficient for a first superposition of the first directional signal with the second directional signal for the purpose of noise suppression. The first directional signal and the second directional signal are used to determine at a second response time a second adaptation coefficient for a second superposition of the first directional signal with the second directional signal for the purpose of noise suppression. It is intended here that the first adaptation coefficient and the second adaptation coefficient are used to determine an output adaptation coefficient for forming an output signal by superposition of the first directional signal and the second directional signal. The subject matter of the dependent claims and of the description below contains advantageous embodiments, some of which are inventive in their own right.

In this context, a first directional signal and/or a second directional signal refer in particular to an electrical signal which, for a given test sound signal having a constant sound pressure and hence a fixed volume level, has a sensitivity that depends on the direction of the sound source of the test sound signal. This means in particular that a spatial direction exists in which the test sound signal results in a maximum signal level in the first directional signal and/or second directional signal, and that at least one additional spatial direction exists for which the test sound signal results in a minimum signal level in the respective directional signals. The spatial directions of maximum and minimum sensitivity of the first directional signal here differ from the respective spatial directions for maximum and minimum sensitivity of the second directional signal. The first directional signal and the second directional signal are preferably configured such that their directions of maximum and minimum sensitivity are arranged in mirror symmetry with respect to each other, and hence the direction of maximum sensitivity for the first directional signal coincides with the direction of minimum sensitivity of the second directional signal, and vice versa. Particularly preferably, a sound signal is completely suppressed in the direction of minimum sensitivity of the first and/or of the second directional signal, and therefore accordingly in the first and/or second directional signal, a sound signal from the direction of minimum sensitivity for that signal does not contribute to the level.

The first superposition and/or the second superposition are here preferably of the form $F+\alpha \cdot B$, where F and B respectively denote the first directional signal and second directional signal, and a denotes the first and/or second adaptation coefficient. Thus the first and second adaptation coefficient define the size of the component of the second directional signal in the first and second superposition respectively. Determining the first adaptation coefficient and the second adaptation coefficient can be repeated here at predetermined time intervals, whereby the first and second adaptation coefficient respectively are updated on each occasion. The time intervals for these updates are given here by the first and second response time respectively. The particular consequence of this is that a change occurring in the sound signal at a specific time instant cannot affect the respective adaptation coefficients until during the next respective updates at the corresponding response time.

The first adaptation coefficient is determined here such that a noise, in particular a transient noise, is suppressed particularly effectively by the corresponding first superposition of the first directional signal with the second directional signal. It is now assumed for this that a sound source of a wanted signal lies in the direction of maximum sensitivity of the first directional signal. Noises, in particular transient noises, that now reach the hearing device from another spatial direction can then be suppressed by the first superposition as a consequence of the different directivity pattern of the second directional signal compared with the first directional signal. If the direction of maximum sensitivity of the first directional signal coincides with the direction of minimum sensitivity of the second directional signal, then it is possible to use in particular the minimum total power of the signal resulting from the first superposition as a criterion for suppressing as effectively as possible noises that do not originate from the direction of the maximum sensitivity of the first directional signal. The equivalent applies to the second superposition. It is advantageous here that the direction of maximum sensitivity of the first directional signal lies in the frontal direction of the user of the hearing device when the hearing device is being worn as intended.

The first response time can then be selected such that the first superposition using the first adaptation coefficient responds sufficiently fast to transient noises, and hence the first adaptation coefficient is particularly suitable for suppressing these noises. It can then be achieved by suitable selection of the second response time that the second superposition using the second adaptation coefficient suppresses in particular steady noises, while the second superposition responds more slowly to substantially transient noises. For this purpose, the second response time can be selected statically to be greater than the first response time by a predetermined factor, or else determined dynamically on the basis of the first and second directional signals. This includes in particular the case in which, if a substantially transient noise component is detected on the basis of the first and second directional signals, updating the second adaptation coefficient is suspended until the end of this transient noise component. The second response time is thus made dependent on the duration of the transient noise component.

In particular here, the first superposition and the second superposition are formed in order to determine the first adaptation coefficient and the second adaptation coefficient at the corresponding response times, but without a signal for output being generated in either case that would be processed further in any manner in the hearing device. The output signal that is formed by superposition of the first directional signal and the second directional signal using the output adaptation coefficient does constitute, however, such a signal intended for further use for signal processing in the hearing device. The output adaptation coefficient is formed on the basis of the first adaptation coefficient and the second adaptation coefficient such that the output signal resulting from the superposition based on the output adaptation coefficient exhibits sufficient suppression of transient noise components as a consequence of the at least indirect dependency on the first adaptation coefficient, while the co-modulation of steady noise components is reduced by virtue of the corresponding, at least indirect, dependency on the second adaptation coefficient.

If the first adaptation coefficient is determined here such that the first superposition optimally suppresses transient noise components, then the deviation of the output adaptation coefficient from the first adaptation coefficient is acceptance of sub-optimum suppression in terms of the transient noise components. An improvement in the SNR is achieved here by the reduced co-modulation of the steady noise components that results from the component of the second adaptation coefficient in the output adaptation coefficient, i.e. specifically by a lower rise in a noise background during the suppression of the transient noise components, which suppression is activated by the first adaptation coefficient, with this improvement in the SNR improving overall the hearing experience and in particular the speech intelligibility.

The second response time is advantageously greater than the first response time. In particular, the second response time is greater than the first response time at least by a factor of 2. It can thereby be ensured that for transient noise in the sound signal, the first adaptation coefficient is adapted first. If the second response time is determined dynamically, the resultant difference between the second response time and the first response time means that in this case there is still enough time for the signal processing processes required for the dynamic adaptation. If the second response time is not determined dynamically but is statically fixed, the second response time may be greater than the first response time in particular by a factor of 4 to 64.

Advantageously the second response time for determining the second adaptation coefficient is determined on the basis of the first directional signal and the second directional signal. This means in particular that a presence of a transient noise component in the ambient sound signal is established on the basis of the first directional signal and the second directional signal, and the second response time is set according to the existence of such a noise component. In particular in this case, if it is established that a transient noise component is present, the second response time can be set dynamically to an ascertained end of this noise component. This means in particular that initially, if it is ascertained that said noise component is present, updating of the second adaptation coefficient can be suspended until an end of the noise component is ascertained on the basis of the first directional signal and the second directional signal. Only then is updating of the second adaptation coefficient resumed. It can hence be ensured that the second adaptation coefficient is not affected by transient noise components, and the corresponding second superposition is mainly only effective for noise suppression of steady noises. While the updating of the second adaptation coefficient is suspended, the most recent value of the second adaptation coefficient in particular can continue to be used until another update.

It proves advantageous here if the second response time for determining the second adaptation coefficient is determined on the basis of a difference between the signal power and a background noise power for the first directional signal and/or on the basis of a difference between the signal power and a background noise power for the second directional signal. The background noise power of the first and/or second directional signal shall be understood to mean here specifically the signal power of a background noise that has been ascertained in a separate estimation process. In particular for this purpose, the background noise is assumed to be substantially steady, and therefore, within the relevant time scales, transient noise components make no significant contribution to the corresponding background noise. In this case, although a transient noise makes a significant contribution to the signal power, it does not contribute significantly to the background noise power in one of the two directional signals. By comparing the difference between signal power and background noise power for the first directional signal with the difference between signal power and background noise power for the second directional signal, it can also be established whether the transient contribution is the assumed wanted signal, so for instance a speech signal from a conversational partner in a frontal direction to the user, or is transient noise to the side.

In an advantageous embodiment of the invention, a target value for a signal power of the output signal is specified, wherein the output adaptation coefficient is determined such that the actual signal power of the output signal has a minimum deviation from the target value. In particular, the output adaptation coefficient can be determined iteratively here. If the first adaptation coefficient is determined on the basis of a minimum signal power of the signal resulting from the first superposition, the first superposition can be deemed optimum with regard to the noises, whether steady or transient in nature, that exist at a specific time instant. A superposition of the first directional signal with the second directional signal on the basis of an adaptation coefficient that differs from the first adaptation coefficient is no longer optimum in this sense. In order to have available in this case a deterministically implementable criterion for determining the output adaptation coefficient on the basis of the first and second adaptation coefficients, it is now proposed to define as such a criterion a target value for the signal power of the output signal resulting from the associated superposition. In particular here, the target value can be in a fixed ratio of the signal powers from the first and second superpositions to the aforementioned minimum value of the signal power or a predetermined level difference from the minimum value of the signal power. The predetermined level difference can equal 2 to 3 dB for instance here. If the first and second adaptation coefficients have already been determined, it is thereby possible to set on the basis thereof the output adaptation coefficient such that the signal power of the output signal then equals the target value, or has a minimum deviation therefrom if the target value cannot be achieved within the bounds of the predetermined values.

Advantageously, an instantaneous value of the output adaptation coefficient is formed by a linear combination of the first adaptation coefficient and the second adaptation coefficient. This is understood to mean in particular here a convex linear combination, i.e. the two linear factors to be used sum to 1 and each has a positive sign. A simple linear combination is computationally particularly easy to implement, which reduces the time involved in the signal processing for generating the output signal and delivers sufficiently good results in the context of the requirement to improve the SNR.

It is preferred that in the hearing device, a first microphone produces a first microphone signal and a second microphone produces a second microphone signal from the sound signal. The first directional signal and/or the second directional signal are generated from the first microphone signal and the second microphone signal. A first microphone and/or a second microphone refer here generally to an electro-acoustic transducer that is configured to produce an electrical signal from a sound signal. In particular in this case, the first directional signal and/or the second directional signal are each formed from the first microphone signal and the second microphone signal. In many hearing device systems, including in binaural hearing device systems, there are often only two microphones available locally, and therefore associated directional signals are formed locally in the hearing device from two microphone signals. In a binaural hearing device system, the local directional signals can subsequently still be processed further to improve the directionality. If there are only two microphone signals available locally in a hearing device, the proposed method provides particularly effective suppression of transient noises while reducing a steady background noise.

Advantageously in this case, the first directional signal and/or the second directional signal are generated by a time-delayed superposition of the first microphone signal with the second microphone signal. The acoustic propagation time difference between the first microphone and the second microphone is preferably used here for the time delay in the superposition. This technique is particularly easy to implement yet effective for generating a directional signal when the microphone signals on which it is based originate from omnidirectional microphones.

Particularly preferably in this case, the first directional signal has a directionality in the form of a first cardioid oriented in a first direction, and/or the second directional signal has a directionality in the form of a second cardioid oriented in a second direction. A cardioid signal is characterized in that the direction of minimum sensitivity is opposite to the direction of maximum sensitivity. This is not the case, for example, for signals having a directivity pattern in the form of a supercardioid or a hypercardioid. In addition, for a cardioid directivity pattern, a sound signal from the direction of the minimum sensitivity is completely suppressed in the ideal case. The symmetry between the direction of the maximum sensitivity and of the minimum sensitivity thus allows calculations for the first and second superpositions for the noise suppression to be kept particularly simple because, in addition, the sensitivity increases strictly monotonically from the direction of minimum sensitivity to the direction of maximum sensitivity. Particularly preferably in this case, the first direction is opposite to the second direction.

Against the background that in a directional signal having a cardioid directivity pattern, sound signals from the direction of the minimum sensitivity are completely suppressed in the ideal case, the calculation of the first and second adaptation coefficients can thereby be simplified even further, because the first directional signal can be assumed to be the reference directed at the wanted-signal source, and in this case, if the second, cardioid, directional signal is oriented opposite to the first directional signal, noise suppression by the second directional signal has no effect on the contribution of the wanted signal. Thus in order to determine the first and/or second adaptation coefficients for suppressing noise as effectively as possible, then simply a minimum signal power in the signal resulting from the first and/or second superposition can be stipulated, without this having any effect on the contribution of the wanted signal.

The invention also defines a hearing device containing a first microphone and a second microphone for producing a first directional signal and a second directional signal, and comprising a control unit, which is configured to perform the method described above. The advantages mentioned for the method and for its developments can be applied analogously to the hearing device.

Other features which are considered as characteristic for the invention are set forth in the appended claims.

Although the invention is illustrated and described herein as embodied in a method for operating a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Corresponding parts and variables are denoted by the same reference signs in each of the figures.

Figure 1:
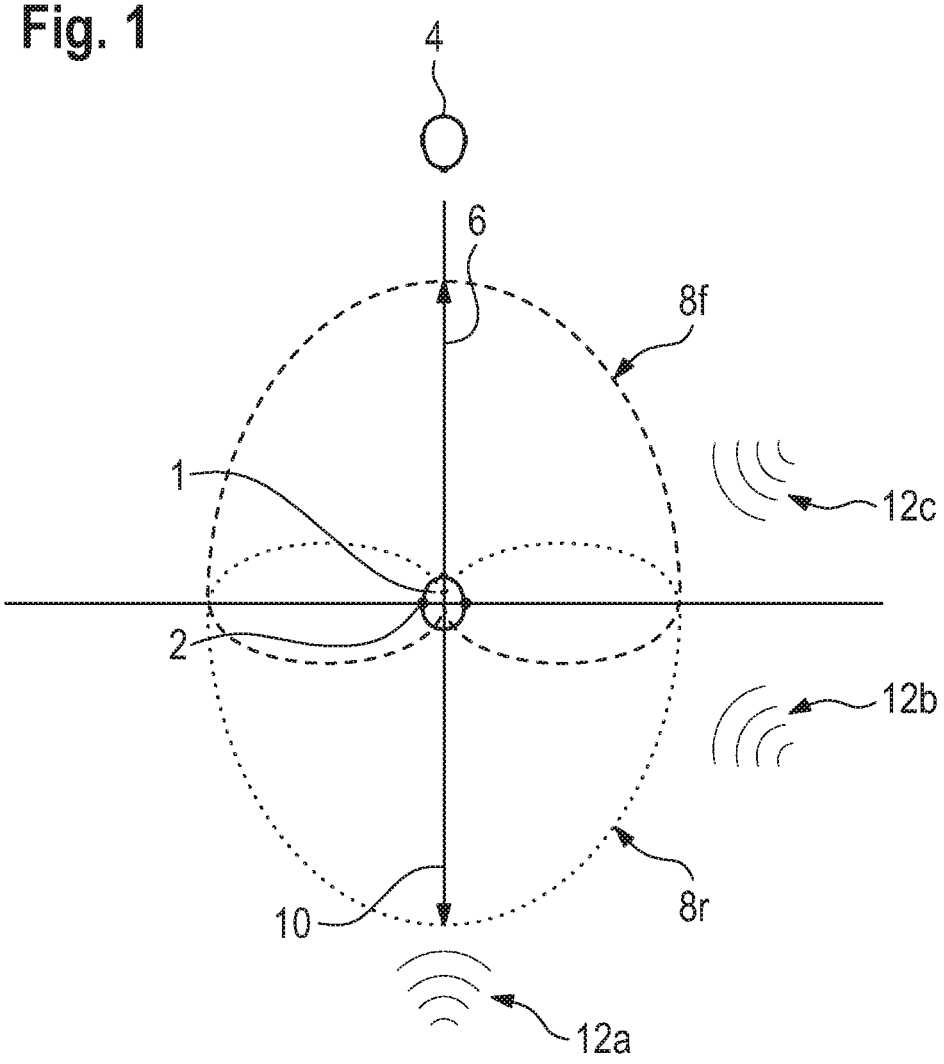
FIG. 1 is a diagrammatic, plan view an attenuation of a directional noise signal by superimposing two directional signals in a hearing device.

FIG. 1 shows schematically in a plan view a user 1 of a hearing device 2. The user 1 is in a conversational situation with a conversational partner 4, who is positioned in a frontal direction 6 with respect to the user 1. A first directional signal 8*f* (dashed line) and a second directional signal 8*r* (dotted line) are formed in the hearing device 2 in a manner not shown in greater detail, each directional signal having a directivity pattern given by a cardioid. The cardioid directivity pattern of the first directional signal 8*f* results in a maximum sensitivity for sound signals from the frontal direction 6, and thus sound signals from this direction are included in the first directional signal 8*f* as a maximum, whereas sound signals from the backwards direction 10 opposite to the frontal direction 6 are ideally completely suppressed in the first directional signal 8*f*. The second directional signal 8*r* has a directivity pattern that is opposite to the first directional signal 8*f*, and therefore sound signals from the backwards direction 10 are included in the second directional signal 8*r* as a maximum, whereas sounds signals from the frontal direction 6 are ideally completely suppressed.

Noises 12*a*, 12*b*, 12*c* that do not come from the frontal direction 6 can then be attenuated in the hearing device 2 by a superposition of the first directional signal 8*f* with the second directional signal 8*r* of the form $F+\alpha \cdot B$, where F and B are the first directional signal and second directional signal respectively, and a is an adaptation coefficient that must be suitably selected. The assumption is made here that the wanted-signal source, i.e. in this case the conversational partner 4, is in the frontal direction 6 and hence the contributions therefrom in the second directional signal 8*r* are completely suppressed, and therefore are included only by the first directional signal 8*f* in the signal $F+\alpha \cdot B$ resulting from the superposition. The contribution of the second directional signal 8*r* in the resultant signal must therefore be adapted by means of the adaptation coefficient $\alpha$ such that the resultant signal has a minimum signal level, because this guarantees, not least for the reason that the contribution of the wanted signal from the frontal direction 6 is constant as a is varied (see above), that the attenuation of the signal components that do not come from the frontal direction 6 is a maximum.

For the noise 12*a*, this can be achieved by a simple selection of $\alpha=0$, so that in this case the resultant signal is equal to the first directional signal 8*f*, and the noise 12*a* in this is completely suppressed. For the noises 12*b*, 12*c*, a non-trivial selection for a is necessary, where the magnitude of a for the noise 12*b* must be chosen to be smaller than for suppressing the noise 12*c*, because for the noise 12*b* already a significantly stronger attenuation is achieved by the first directional signal 8*f* and therefore only a smaller adaptation is needed by means of the second directional signal 8*r* than is the case for the noise 12*c*, which comes from the front hemisphere of the user 2 and thus is included far more strongly in the first directional signal 8*f*.

If then one of the noises 12*b*, 12*c* occurs transiently, so for instance containing time intervals of considerable signal contributions followed by time intervals without any signal activity, as is often the case for spoken language, then this results in corresponding fluctuations in the adaptation coefficient $\alpha$. In order to ensure effective suppression of the noises 12*b*, 12*c*, the adaptation coefficient $\alpha$ must be updated at sufficiently short time intervals. If now one of the two noises 12*b*, 12*c*, say for instance 12*c*, exhibits significantly transient behavior but the other noise 12*b* is substantially steady, or alternatively or even additionally, a steady background noise exists, the fluctuation in the adaptation coefficient $\alpha$ resulting from the fluctuations in the level of the noise 12*c* causes the steady noise 12*b* and/or the steady background noise to be incorporated in the signal resulting from the superposition to a greater or lesser degree depending on the activity of the noise 12*c*. If there is only a steady background noise in addition to the transient noise 12*c*, this can even result in a non-trivial superposition taking place only when the noise 12*c* is actually active, which means that as a result of the steady noise components in the second directional signal 8*b*, the noise in the resultant signal increases, thereby degrading the SNR.

Figure 2:
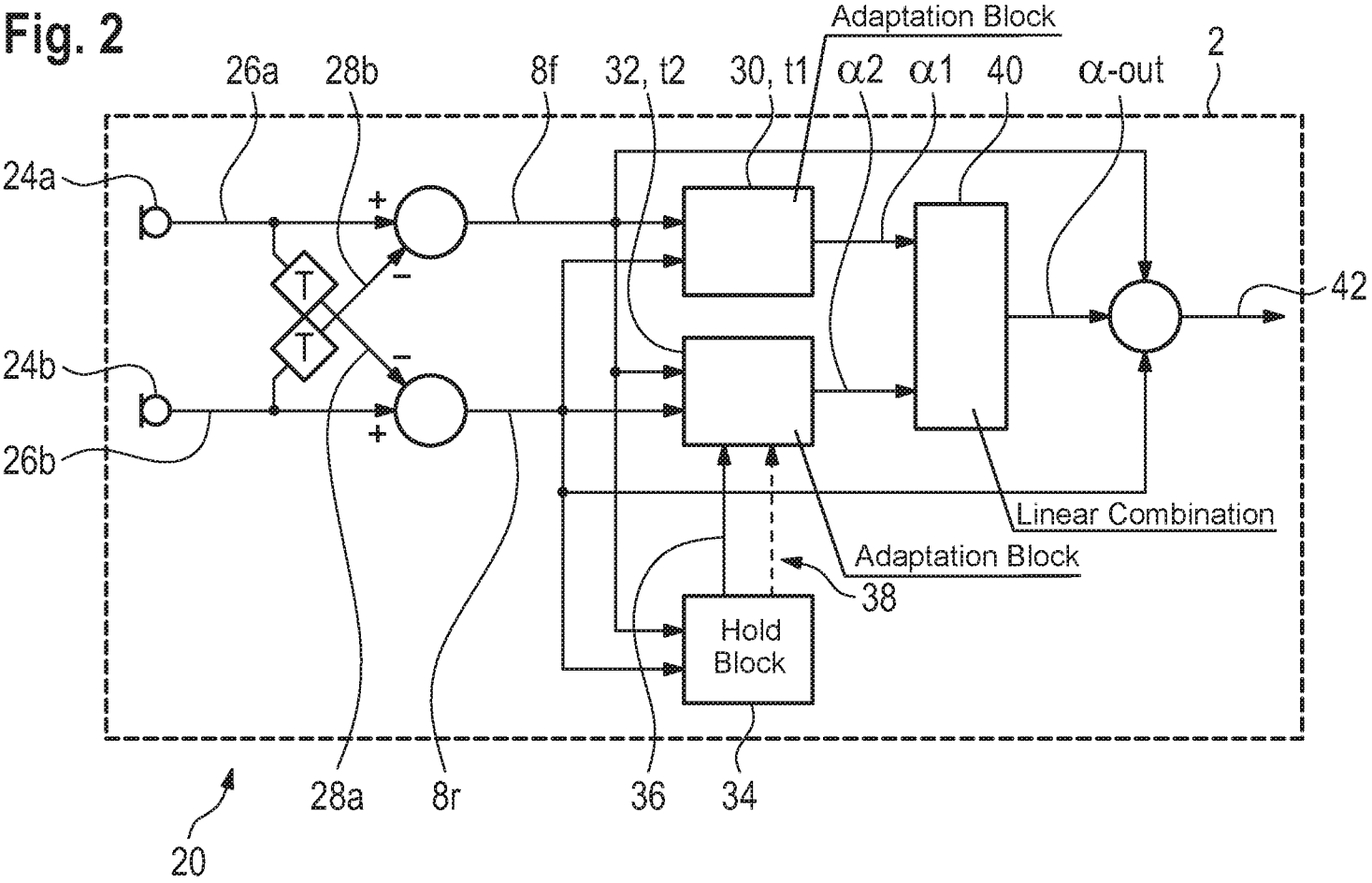
FIG. 2 is a block diagram of the procedure of a method for attenuating directional noise signals in a hearing device.

A method 20, which is shown in the block diagram in FIG. 2, is intended to eliminate this problem. In the hearing device 2, a first microphone 24*a* is used to produce a first microphone signal 26*a* and a second microphone 24*b* is used to produce a second microphone signal 26*b* from the ambient sound signal 22. In this method, the second microphone signal 26*b* is delayed by the time interval T to form a time-delayed second microphone signal 28*b*, which is subtracted from the first microphone signal 26*a* to form the first directional signal 8*f*. Similarly, the first microphone signal 26*a* is also delayed by the time interval T to form the first time-delayed microphone signal 28*a*, which is subtracted from the second microphone signal 26*b* to form the second directional signal 8*r*. The first directional signal 8*f* and the second directional signal 8*r* here each exhibit the cardioid directivity patterns shown in FIG. 1.

In a first adaptation block 30, the first directional signal 8*f* and the second directional signal 8*r* are used to determine at a first response time t1 a first adaptation coefficient $\alpha$1 for a corresponding superposition of the first directional signal 8*f* with the second directional signal 8*r*. The first response time t1 shall preferably be selected here such that the first adaptation block determines the first adaptation coefficient $\alpha$1 such that a transient noise is suppressed particularly effectively in the sound signal 22 by a corresponding superposition $F+\alpha 1 \cdot B$. This is achieved in particular by, as regards the response time t1, a signal resulting from such a superposition having a minimum signal power.

In a second adaptation block 32, the first directional signal 8*f* and the second directional signal 8*r* are used to determine at a second response time t2 a second adaptation coefficient α2 for a corresponding superposition of the first directional signal 8*f* with the second directional signal 8*r*. In this case, the second response time t2 is greater than the first response time t1 by at least a factor of 2. As a consequence, the second adaptation block 32 responds more slowly to changes in the sound signal 22 than does the first adaptation block 30, and thus compared with the first adaptation block 30 is configured rather to suppress steady noises by a superposition F+α2·B. For significantly transient noise components in the sound signal 22, the situation can specifically arise that a noise component occurring suddenly would already have been suppressed by an adaptation according to the first adaptation block 30, whereas an adaptation according to the second adaptation block 32 does not yet take any account of the noise component in the corresponding second adaptation coefficient α2 because of the longer second response time t2. The second adaptation block 32 always takes sufficient account of largely steady noises, however.

In addition, in a hold block 34, a hold signal 36 is generated on the basis of the first directional signal 8*f* and the second directional signal 8*r*, which hold signal pauses the update of the second adaptation coefficient α2 completely if transient noise components are present in the sound signal 22. This means that if in the hold block 34, transient noise components are detected in the first and/or second directional signal 8*f*, 8*r*, the value of the second adaptation coefficient α2 is no longer varied but remains at the value at the time of the pause. From then on, only the first adaptation coefficient α1 continues to be updated on the basis of the transient noise components. If it is detected in the hold block 34 that there are no longer any significant transient noise components, then a resume signal 38 is output to the second adaptation block 32, in response to which the second adaptation coefficient is again updated at the second response time t2 in the second adaptation block 32.

The decision in the hold block 34 whether transient noise components are present in the sound signal 22, i.e. whether to output a hold signal 36 or a resume signal 38, can be made here in particular by comparing the signal power both with the background noise power in the first directional signal 8*f* and with the background noise power in the second directional signal 8*r*. For example, if in the second directional signal 8*r* there is only a small difference between the input power and the background noise power, whereas for the first directional signal 8*f* there is a significant difference between the input power and the background noise power, then it can be assumed therefrom that directional, transient noise is present in the region of the forward-facing cardioid, which corresponds to the first directional signal 8*f*. In this case, by outputting a hold signal 36, the updating of the second adaptation coefficient α2 in the second adaptation block 32 is paused temporarily until the corresponding transient noise is no longer registered.

An output adaptation coefficient α-out is now formed by a linear combination 40 of the first adaptation coefficient α1 with the second adaptation coefficient α2. An output signal 42 is then formed from the first directional signal 8*f* and the second directional signal 8*r* by a corresponding superposition of the form F+α-out·B. The linear combination 40 is here of the form $$\alpha\text{-out}=\alpha 1\cdot w+\alpha 2\cdot(1-w). \quad \text{a)}$$

For determining the parameter w, a target value is defined here for the signal power of the output signal 42. This can lie, for example, 3 dB above the value of the output power that an output signal resulting from a superposition using the first adaptation coefficient α1 would have, and hence would be a minimum. The target value of the signal power of the output signal 42 thus constitutes a boundary condition with respect to which the parameter w is relaxed in order to arrive at the output adaptation coefficient α-out from the first adaptation coefficient α1, which is optimum in terms of a minimum output power, by the corresponding linear combination with a sub-optimum second adaptation coefficient α2, which output adaptation coefficient is ultimately used for the superposition that produces the output signal 42.

It can be achieved by the proposed procedure that in the case of transient, in particular highly directional, noise components, by virtue of the finally applied adaptation, fewer components of a steady background noise are modulated onto the output signal 42 when a component of the transient noise is actually present. This is done at the expense of suppression of the transient noise signal, which suppression is no longer optimum, although this can be accepted because thanks to the reduced co-modulation of the steady noise, it is still possible to achieve an improved SNR and hence in particular improved speech intelligibility of the wanted signal.

Although the invention has been illustrated and described in greater detail using the preferred exemplary embodiment, the invention is not limited by this exemplary embodiment. A person skilled in the art can derive other variations therefrom without departing from the scope of protection of the invention.

The following is a summary list of reference numerals and the corresponding structure used in the above description of the invention:

1 user
2 hearing device
4 conversational partner
6 frontal direction
8*f* first directional signal
8*r* second directional signal
10 backwards direction
12*a-c* noise
20 method
22 sound signal
24*a/b* first/second microphone
26*a/b* first/second microphone signal
28*a/b* first/second time-delayed microphone signal
30 first adaptation block
32 second adaptation block
34 hold block
36 hold signal
38 resume signal
40 linear combination
42 output signal
α1 first adaptation coefficient
α2 second adaptation coefficient
α-out output adaptation coefficient
T time interval
t1 first response time
t2 second response time

The invention claimed is:

1. A method for operating a hearing device, which comprises:

generating in the hearing device a first directional signal and a second directional signal from an ambient sound signal;

using the first directional signal and the second directional signal to determine at a first response time a first adaptation coefficient, the first adaptation coefficient being generated from a first superposition of the first directional signal with the second directional signal in a first adaptation module for assisting in noise suppression;

using the first directional signal and the second directional signal to determine at a second response time a second adaptation coefficient, the second adaptation coefficient being generated from a second superposition of the first directional signal with the second directional signal in a second adaptation module for assisting in the noise suppression; and using the first adaptation coefficient and the second adaptation coefficient to determine an output adaptation coefficient for forming an output signal by superposition of the first directional signal and the second directional signal.

2. The method according to claim 1, wherein the second response time is greater than the first response time.

3. The method according to claim 1, which further comprises determining the second response time for determining the second adaptation coefficient on a basis of the first directional signal and the second directional signal.

4. The method according to claim 3, which further comprises determining the second response time for determining the second adaptation coefficient on a basis of a difference between a signal power and a background noise power for the first directional signal and/or on a basis of a difference between a signal power and a background noise power for the second directional signal.

5. The method according to claim 1, wherein:

a target value for a signal power of the output signal is specified; and the output adaptation coefficient is determined such that the signal power of the output signal has a minimum deviation from the target value.

6. The method according to claim 1, wherein an instantaneous value of the output adaptation coefficient is formed by a linear combination of the first adaptation coefficient and the second adaptation coefficient.

7. The method according to claim 1, which further comprises:

providing the hearing device with a first microphone producing a first microphone signal and a second microphone producing a second microphone signal from the ambient sound signal; and generating the first directional signal and/or the second directional signal from the first microphone signal and the second microphone signal.

8. The method according to claim 7, which further comprises generating the first directional signal and/or the second directional signal from a time-delayed superposition of the first microphone signal with the second microphone signal.

9. The method according to claim 8, wherein:

the first directional signal has a directionality in a form of a first cardioid oriented in a first direction; and/or the second directional signal has a directionality in a form of a second cardioid oriented in a second direction.

10. The method according to claim 9, wherein the first direction is opposite to the second direction.

11. A hearing device, comprising:

a first microphone producing a first directional signal;

a second microphone producing a second directional signal; and a first adaptation module connected to said first and second microphones and receiving the first and second directional signals;

a second adaptation module connected to said first and second microphones and receiving the first and second directional signals;

a control unit configured to perform a method for operating the hearing device, which comprises the steps of:

generating in the hearing device the first directional signal and the second directional signal from an ambient sound signal;

using the first directional signal and the second directional signal to determine at a first response time a first adaptation coefficient, the first adaptation coefficient being generated from a first superposition of the first directional signal with the second directional signal in said first adaptation module for assisting in noise suppression;

using the first directional signal and the second directional signal to determine at a second response time a second adaptation coefficient, the second adaptation coefficient being generated from a second superposition of the first directional signal with the second directional signal in said second adaptation module for assisting in the noise suppression; and using the first adaptation coefficient and the second adaptation coefficient to determine an output adaptation coefficient for forming an output signal by superposition of the first directional signal and the second directional signal.

* * * * *